US008692008B2

(12) United States Patent
Fabβbender

(10) Patent No.: US 8,692,008 B2
(45) Date of Patent: Apr. 8, 2014

(54) USE OF METHANESULFONIC ACID FOR PREPARING FATTY ACID ESTERS

(75) Inventor: Stefan Fabβbender, Speyer (DE)

(73) Assignee: BASF SE, Ludwigshafen (DE)

( * ) Notice: Subject to any disclaimer, the term of this patent is extended or adjusted under 35 U.S.C. 154(b) by 314 days.

(21) Appl. No.: 13/129,202

(22) PCT Filed: Nov. 16, 2009

(86) PCT No.: PCT/EP2009/065230

§ 371 (c)(1),
(2), (4) Date: Jun. 2, 2011

(87) PCT Pub. No.: WO2010/055158

PCT Pub. Date: May 20, 2010

(65) Prior Publication Data

US 2011/0245521 A1 Oct. 6, 2011

(30) Foreign Application Priority Data

Nov. 17, 2008 (EP) ..... 08169225

(51) Int. Cl.
*C11C 3/04* (2006.01)

(52) U.S. Cl.
USPC ..... 554/169; 554/187; 554/175; 554/163; 554/161; 554/154; 554/124

(58) Field of Classification Search
None
See application file for complete search history.

(56) References Cited

U.S. PATENT DOCUMENTS

| | | | | |
|---|---|---|---|---|
| 5,276,204 | A * | 1/1994 | Schmid et al. | 568/616 |
| 5,885,946 | A * | 3/1999 | Lamsa | 508/485 |
| 2007/0293700 | A1 | 12/2007 | Giovanetti et al. | |
| 2009/0320355 | A1 | 12/2009 | Vieira et al. | |

FOREIGN PATENT DOCUMENTS

| | | |
|---|---|---|
| EP | 0 658 183 | 6/1995 |
| EP | 1 529 766 | 5/2005 |
| WO | 2006 081644 | 8/2006 |
| WO | 2007 020465 | 2/2007 |

OTHER PUBLICATIONS

Aranda, D. A. G. et al., "Acid-Catalyzed Homogeneous Esterification Reaction for Biodiesel Production From Palm Fatty Acids" Catalysis Letters, vol. 122, No. 1-2, pp. 20-25, XP-19570830, (Nov. 1, 2007).
International Search Report Issued Mar. 26, 2010 in PCT/EP09/065230 filed Nov. 16, 2009.

* cited by examiner

*Primary Examiner* — Yate K Cutliff
(74) *Attorney, Agent, or Firm* — Oblon, Spivak, McClelland, Maier & Neustadt, L.L.P.

(57) ABSTRACT

The present invention relates to a process for preparing fatty acid esters and/or fatty acid ester mixtures of monohydric alcohols having 1 to 5 carbon atoms by transesterifying fatty acid glycerides with monohydric alcohols in the presence of a basic catalyst, in the course of which methanesulfonic acid is used. The invention further relates to the use of methanesulfonic acid for preparing these fatty acid esters.

20 Claims, 1 Drawing Sheet

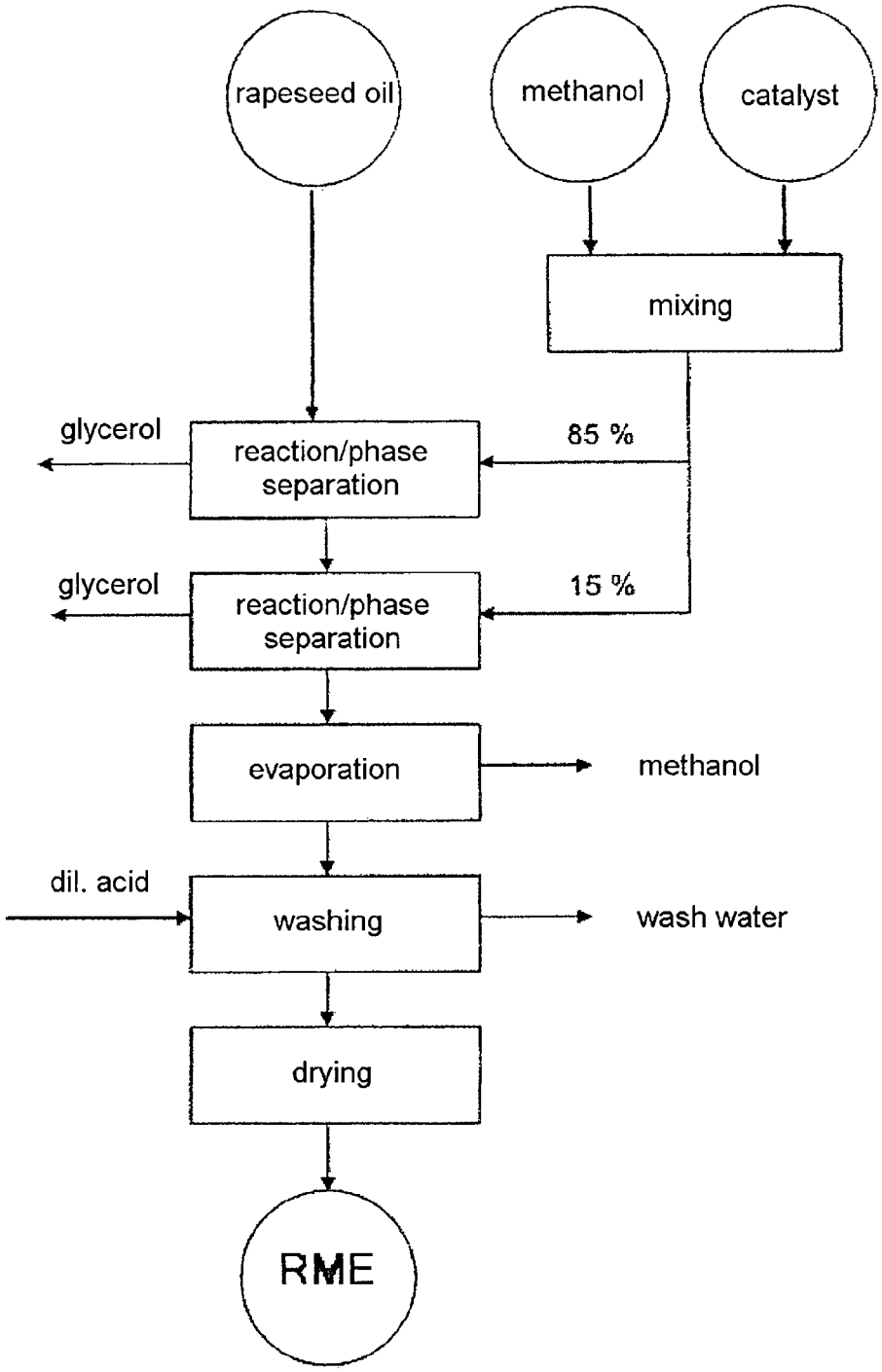
rapeseed oil
methanol
catalyst
mixing
glycerol
reaction/phase separation
85 %
glycerol
reaction/phase separation
15 %
evaporation
methanol
dil. acid
washing
wash water
drying
RME

USE OF METHANESULFONIC ACID FOR PREPARING FATTY ACID ESTERS

This application is a 371 of PCT/EP2009/065230 filed Nov. 16, 2009. Priority to European patent application 08169225.3, filed Nov. 17, 2008, is claimed.

The present invention relates to a process for preparing fatty acid esters and/or fatty acid ester mixtures of monohydric alcohols having 1 to 5 carbon atoms by transesterifying fatty acid glycerides with short-chain monohydric alcohols having 1-5 carbon atoms in the presence of a basic catalyst, in the course of which methanesulfonic acid is used. The invention further relates to the use of methanesulfonic acid for preparing these fatty acid esters.

The fatty acid esters prepared in accordance with the invention are suitable, according to the starting materials used, as pharmaceutical, dietary or cosmetic raw materials, as intermediates for further fatty acid derivatives, such as fatty alcohols, fatty amines or surfactants. Fatty acid esters are also particularly suitable as lubricants, plasticizers, hydraulic oils, fuels, or fuels for operating diesel engines.

Owing to their suitability as a diesel fuel, fatty acid esters have gained particular significance in recent times for reasons of environmental protection, and of the replacement of fossil energy sources by renewable energy sources.

The preparation of the fatty acid esters has been known for some time. Especially biodiesel is now obtained on the industrial scale by means of a catalytic transesterification of vegetable oil. Usually dewatered, deacidified and degummed oil is reacted with a molar alcohol excess (usually methanol) of 6:1 using 1% by weight of catalyst based on the amount of the oil used (usually KOH) above the boiling temperature of the alcohol. The fatty acids present in the fat molecules of the oil are catalytically eliminated and react with the alcohol present to give the fatty acid ester. Fats and oils are generally triglycerides, which means that a fat molecule comprises three fatty acids bonded to one glycerol molecule. A complete transesterification reaction, as performed in the production of biodiesel, thus generates three "molecules of biodiesel" and one molecule of glycerol per molecule of fat or oil. Intermediates of this reaction are mono- and diglycerides. Mono- and diglycerides consist of a glycerol base skeleton, also referred to hereinafter as glycerol backbone, to which one fatty acid (monoglyceride) or two fatty acids (diglyceride) are also bonded. Since both polar hydroxide groups and apolar hydrocarbon chains are present in mono- and diglycerides, they have amphiphilic properties and, in organic solvents, almost always change the polarity of this solvent.

The transesterification requires a reaction time of about 8 h, which presently achieves a conversion of about 98%.

After the reaction, the glycerol formed, which is insoluble in the fatty acid alkyl ester (FAAE) is removed from the biodiesel by means of a phase separator and, after a chemical and distillative purification, utilized as an industrial or pharmaceutical raw material.

The excess alcohol present in the fatty acid alkyl esters (FAAE) is removed by means of distillation and recycled into the process. After removal and recycling of the excess alcohol, the remaining alkaline catalysts (e.g. KOH) are neutralized by adding a dilute organic or inorganic acid and, on completion of phase separation, the fatty acid ester phase is drawn off. Such a process is disclosed, for example, in EP 0 658 183 A1. Organic or inorganic acids mentioned include phosphoric acid, sulfuric acid, hydrochloric acid, nitric acid, boric acid, formic acid, acetic acid, lactic acid, gluconic acid, oxalic acid, succinic acid, maleic acid, tartaric acid, malic acid and citric acid, and also organic sulfonic acids and sulfuric monoesters. Sulfuric acid is currently used with preference in the neutralization of the alkaline catalysts.

The sales of biodiesel in the Federal Republic of Germany were 1.2 million tonnes in 2004, and were already 1.8 million tonnes in 2005. The amounts stated above make it clear that it is viable from an economic point of view to provide processes for producing biodiesel which afford increased yields of fatty acid esters compared to the processes utilized to date.

It is an object of the present invention to provide a process for preparing fatty acid esters with improved yields. The process for preparing fatty acid esters should be integrable into known preparation processes without any great apparatus complexity.

This object is achieved by a process for preparing fatty acid esters and/or fatty acid ester mixtures of short-chain monohydric alcohols having 1 to 5 carbon atoms, comprising (a) the transesterification of fatty acid glycerides with short-chain monohydric alcohols having 1 to 5 carbon atoms in the presence of at least one basic catalyst to form a reaction mixture which comprises the fatty acid ester and/or the fatty acid ester mixture, and (b) the treatment of at least a portion of the reaction mixture formed in the transesterification in step (a) with methanesulfonic acid.

It is found that especially the use of methanesulfonic acid in the process according to the invention for neutralization of the basic catalysts used in the transesterification in process step (a) allows significantly higher yields of fatty acid esters or fatty acid ester mixtures to be obtained compared to customary processes in which, for example, a treatment with sulfuric acid is carried out. "The treatment of at least a portion of the reaction mixture formed in the transesterification in process step (a) with methanesulfonic acid" should be understood to mean that the basic catalysts present in the reaction product formed are neutralized directly by means of methanesulfonic acid, or that they are neutralized only on completion of removal of the fatty acid ester phase.

The treatment of the fatty acid ester and/or fatty acid ester mixture with the methanesulfonic acid in step (b) can be effected directly after the transesterification in order to at least substantially neutralize the basic catalyst used in the transesterification.

In a further embodiment of the invention, on completion of transesterification in step (a), the residence time of the reaction products before performance of step (b) can be selected such that a phase separation into a fatty acid ester phase and a glycerol phase takes place. The heavy glycerol phase can then be removed, and the catalyst residues remaining in the ester phase can be neutralized by adding the methanesulfonic acid.

The transesterification in step (a) can generally be carried out in one stage or in two or more stages, i.e. the fatty acid glyceride is either transesterified with the entire amount of lower alcohol and catalyst, or only a portion of the amount of short-chain monohydric alcohol and catalyst required is used for transesterification in a first stage and, on completion of settling and removal of a glycerol phase, the remaining amount(s) of short-chain monohydric alcohol and catalyst are used for transesterification in the same way in a second stage or in further stages, the two- and multistage bringing the advantage of a further decrease in the alcohol excess and additionally increased yields of fatty acid ester.

When the transesterification is effected, in one embodiment of the invention, by the two-stage method, preferably 60% to 90% of the total amount of short-chain alcohol and catalyst required is used in the first stage, and 10% to 40% of the total amount of short-chain alcohol and catalyst in the second stage.

In the two- or multistage method, the treatment with the methanesulfonic acid can be effected immediately after the second or the last transesterification stage in each case, i.e. if appropriate without removing the glycerol content formed in the second or last stage beforehand.

The transesterification in the process according to the invention is effected typically at ambient temperatures of about +5 to +40° C. and atmospheric pressure, and can in principle be performed in any desired open or closed vessel of any size, which is advantageously equipped with a discharge device at the bottom. The process according to the invention can equally be performed using stirrer devices or mechanical intensive mixers. The corresponding apparatuses and embodiments are known to those skilled in the art in the field of apparatus technology; for this reason, they will not be discussed any further here.

In the presence of suitable metering apparatus, of a suitable reactor and of an appropriate monitoring system, the process according to the invention can also be performed continuously.

Suitable fatty acid glycerides which can be transesterified in the process according to the invention include naturally occurring vegetable and animal fats and oils, such as soybean oil, palm oil and palm fat, coconut oil and coconut fat, sunflower oil, rapeseed oil, cotton oil, linseed oil, castor oil, peanut oil, olive oil, safflower oil, evening primrose oil, borage oil, carob seed oil, etc., and also mono-, di- and triglycerides which have been isolated from the aforementioned vegetable oils and fats or obtained by inter-esterification or synthesized, such as triolein, tripalmitin, tristearin, glyceryl monooleate and glyceryl monostearate. It is likewise possible in the process according to the invention also to use waste oils such as used deep fat fryer oil. In the process according to the invention, preference is given to using sunflower oil and rapeseed oil.

The vegetable oils and fats can be used in refined or unrefined form and may, as well as gums, cloudy substances and other impurities, comprise free fatty acids up to a proportion of 20% by weight and higher. In a further embodiment of the invention, dewatered, deacidified and degummed fatty acid glycerides are used as starting materials for the process according to the invention. The use of these leads to simplified control of the process and additionally brings increased yields.

The short-chain monohydric alcohols used are those having 1 to 5 carbon atoms. These are preferably selected from methanol, ethanol, propanol, isopropanol, butanol, isobutanol, 3-methyl-1-butanol and neopentyl alcohol, and mixtures thereof. Particular preference is given to methanol and ethanol; methanol is the most preferred.

In the process according to the invention, useful basic catalysts for the transesterification are alkali metal or alkaline earth metal compounds in the form of the oxides, hydroxides, hydrides, carbonates, acetates or alkoxides of the short-chain alcohols having 1 to 5 carbon atoms, preferably sodium hydroxide, potassium hydroxide, or sodium and potassium alkoxides of the short-chain monohydric alcohols having 1 to 5 carbon atoms. The basic catalysts are more preferably selected from KOH, NaOH, sodium methoxide and potassium methoxide. Especially preferred are potassium methoxide and sodium methoxide.

In a general embodiment of the invention, the basic catalyst is used in the transesterification of the fatty acid glycerides in an amount of 0.1 to 5% by weight, preferably in an amount of 0.5 to 1.5% by weight, based on the mass of the fatty acid glyceride used. The lower monohydric alcohol is added in an excess of 0.1 mol to 2.0 mol, based on 1 mol each of fatty acid bound to glycerol. If appropriate, water is used in an amount of 0.5 to 20% by weight based on the reaction mixture in the transesterification of the fatty acid glycerides.

In a general embodiment of the invention, the basic catalyst is added to the fatty acid glyceride in the form of an aqueous or alcoholic solution. On completion of one-stage or multistage transesterification of the fatty acid glyceride, a certain proportion of water, which is in the range form 0.5 to 20% by weight based on the total mass, may be added to the reaction mixture formed thereby. The water can be added in isolated form or in conjunction with the methanesulfonic acid.

In the treatment of the fatty acid ester or fatty acid ester mixture with the methanesulfonic acid in step (b), the methanesulfonic acid is added in the form of a 50 to 99%, preferably in the form of a 60 to 80% and more preferably in the form of a 70% aqueous solution. This treatment of the resulting ester with the methanesulfonic acid affords, compared to processes known from the prior art in which sulfuric acid was used for neutralization/treatment, up to 4% higher yields of fatty acid esters, which demonstrates the economic advantage of the process according to the invention.

The invention is illustrated in detail by the examples and comparative examples which follow:

The examples and comparative examples detailed below demonstrate the preparation of fatty acid methyl esters (FAME) with subsequent neutralization of the catalyst. In the preparation of the fatty acid alkyl esters, four different catalysts (NaOH, KOH, sodium methoxide and potassium methoxide) are used as alkaline catalysts. The neutralization was effected in the comparative examples using sulfuric acid, and in the examples using methanesulfonic acid. The examples were carried out on the basis of model tests of the industrial processes, in which a product with a minimum methyl ester content of 96.5%, which falls within the standard EN 14214, was obtained.

Equipment and Materials Used

The process conditions were selected on the basis of knowledge of industrial biodiesel production processes. For the tests, a two-stage method of catalyst mixing was practiced. FIG. 1 shows a block diagram of the process for preparing rapeseed oil methyl ester (RME).

The transesterification tests were performed in a sulfonation flask with stirrer, thermometer, reflux condenser or Liebig condenser and bottom outlet. For each transesterification, a catalyst mixture was prepared.

The fatty acid glyceride used was rapeseed oil (full raffinate) from retail. The NaOH, KOH, sodium methoxide and potassium methoxide catalysts, the methanol solvent and the sulfuric acid for the neutralization were purchased from the laboratory specialist trade.

Test Procedure

The examples and comparative examples were performed under the parameters shown in table 1. The analysis data of the products obtained in the four transesterification reactions are shown in table 2.

As is evident from the data shown in table 2, the use of methanesulfonic acid leads to the neutralization of the basic catalysts to give significantly increased yields of fatty acid esters. These are in the range from 2.29 to 3.7% in the case of use of KOH or NaOH, and in the region of 0.2% in the case of use of sodium methoxide or potassium methoxide, which, however, means a considerable economic advantage owing to the high throughputs.

TABLE 1

| | Transesterification 1 | | Transesterification 2 | | Transesterification 3 | | Transesterification 4 | |
|---|---|---|---|---|---|---|---|---|
| Amount of oil | approx. 500 g | | approx. 500 g | | approx 500 g | | approx. 500 g | |
| Catalyst | NaOH | | KOH | | Sodium methoxide $CH_3ONa$ | | Potassium methoxide $CH_3OK$ | |
| Amount of catalyst | 0.88% | | 1.24% | | 0.50% | | 0.50% | |
| Methanol | 19.62% | | 19.26% | | 20.00% | | 20.00% | |
| 1st stage | | | | | | | | |
| Catal. mixt. addition | 85.00% | | 85.00% | | 85.00% | | 85.00% | |
| Reaction temperature | 60° C. | | 60° C. | | 60° C. | | 60° C. | |
| Reaction time | 60 min | | 60 min | | 60 min | | 60 min | |
| Settling time | 1 h | | 1 h | | 1 h | | 1 h | |
| Separation of glycerol phase | | | | | | | | |
| 2nd stage | | | | | | | | |
| Catal. mixt. addition | 15.00% | | 15.00% | | 15.00% | | 15.00% | |
| Reaction temperature | 60° C. | | 60° C. | | 60° C. | | 60° C. | |
| Reaction time | 60 min | | 60 min | | 60 min | | 60 min | |
| Settling time | 1 h | | 1 h | | 1 h | | 1 h | |
| Separation of glycerol phase | | | | | | | | |
| Dist. methanol | Reduced pressure 90° C. | | Reduced pressure 90° C. | | Reduced pressure 90° C. | | Reduced pressure 90° C. | |
| Sampling | Sample 1 | | Sample 2 | | Sample 3 | | Sample 4 | |
| Analysis | Neutralization number | | Neutralization number | | Neutralization number | | Neutralization number | |
| Analysis | Determination: methyl esters of mono-, di-, triglycerides | | Determination: methyl esters of mono-, di-, triglycerides | | Determination: methyl esters of mono-, di-, triglycerides | | Determination: methyl esters of mono-, di-, triglycerides | |
| Neutralization | Sulfuric acid | 70% methane-sulfonic acid | Sulfuric acid | 70% methane-sulfonic acid | Sulfuric acid | 70% methane-sulfonic acid | Sulfuric acid | 70% methane-sulfonic acid |
| | Calculation of amount of acid for neutralization | | | | | | | |
| Amount of water added with acid | 5% | 5% | 5% | 5% | 5% | 5% | 5% | 5% |
| Temperature | 90° C. | 90° C. | 90° C. | 90° C. | 90° C. | 90° C. | 90° C. | 90° C. |
| Reaction time | 15 min | 15 min | 15 min | 15 min | 15 min | 15 min | 15 min | 15 min |
| Separation of wash water | | | | | | | | |
| Drying | 10-20 mbar 90° C. | 10-20 mbar 90° C. | 10-20 mbar 90° C. | 10-20 mbar 90° C. | 10-20 mbar 90° C. | 10-20 mbar 90° C. | 10-20 mbar 90° C. | 10-20 mbar 90° C. |
| Sampling | Sample 5 | Sample 6 | Sample 7 | Sample 8 | Sample 9 | Sample 10 | Sample 11 | Sample 12 |
| Analysis | Determination: Methyl esters of mono-, di-, triglycerides Acid number, neutralization number | | Determination: Methyl esters of mono-, di-, triglycerides Acid number, neutralization number | | Determination: Methyl esters of mono-, di-, triglycerides Acid number, neutralization number | | Determination: Methyl esters of mono-, di-, triglycerides Acid number, neutralization number | |

TABLE 2

| | Transesterification 1 | | | Transesterification 2 | | |
|---|---|---|---|---|---|---|
| | Product | Amount | Unit | Product | Amount | Unit |
| Crude oil | Rapeseed oil | 100 | % | Rapeseed oil | 100 | % |
| Catalyst | NaOH | 0.88 | % | KOH | 1.24 | % |
| Solvent | Methanol | 19.62 | % | Methanol | 19.26 | % |
| Transesterification yield | Crude RME/rapeseed oil | 87.8 | % | Crude RME/rapeseed oil | 95.29 | % |
| Analysis | Methyl ester cont. | 97.3 | % | Methyl ester cont. | 96.9 | % |
| | Monoglyceride | 0.68 | % | Monoglyceride | 0.61 | % |
| | Diglycerides | 0.16 | % | Diglycerides | 0.13 | % |
| | Triglycerides | 0.02 | % | Triglycerides | <0.01 | % |
| | free glycerol | 1.35 | % | free glycerol | 0.42 | % |
| | Total glycerol | 1.55 | % | Total glycerol | 0.59 | % |
| Neutralization | Crude RME | 100 | % | Crude RME | 100 | % |
| | Neutralization number | 0.25 | | Neutralization number | 0.081 | |
| Neutralizing agent | Sulfuric acid | 0.337 | mg/gRME | Sulfuric acid | 0.11 | mg/gRME |
| Neutralization yield | Neutral/crude RME | 95.61 | % | Neutral/crude RME | 94.02 | % |
| Analysis | Methyl ester cont. | 98.4 | % | Methyl ester cont. | 98.5 | % |
| | Monoglyceride | 0.56 | % | Monoglyceride | 0.5 | % |

TABLE 2-continued

| | | | | | | |
|---|---|---|---|---|---|---|
| | Diglycerides | 0.15 | % | Diglycerides | 0.13 | % |
| | Triglycerides | 0.02 | % | Triglycerides | <0.01 | % |
| | Free glycerol | 0.01 | % | Free glycerol | 0.03 | % |
| | Total glycerol | 0.18 | % | Total glycerol | 0.18 | % |
| | Neutralization number | 0.019 | | Neutralization number | 0.058 | |
| | Acid number | 0.21 | | Acid number | 0.21 | |
| Neutralizing agent | Methanesulfonic acid | 0.944 | mg/gRME | Methanesulfonic acid | 0.31 | mg/gRME |
| Neutralization yield | Neutral/crude RME | 97.9 | % | Neutral/crude RME | 97.74 | % |
| Analysis | Methyl ester cont. | 97.8 | % | Methyl ester cont. | 98.3 | % |
| | Monoglyceride | 0.52 | % | Monoglyceride | 0.47 | % |
| | Diglycerides | 0.14 | % | Diglycerides | 0.11 | % |
| | Triglycerides | 0.02 | % | Triglycerides | <0.01 | % |
| | Free glycerol | 0.01 | % | Free glycerol | 0.03 | % |
| | Total glycerol | 0.17 | % | Total glycerol | 0.17 | % |
| | Neutralization number | 0.021 | | Neutralization number | 0.054 | |
| | Acid number | 0.22 | | Acid number | 0.22 | |

| | Transesterification 3 | | | Transesterification 4 | | |
|---|---|---|---|---|---|---|
| | Product | Amount | Unit | Product | Amount | Unit |
| Crude oil | Rapeseed oil | 100 | % | Rapeseed oil | 100 | % |
| Catalyst | Sodium methoxide | 0.5 | % | Potassium methoxide | 0.5 | % |
| Solvent | Methanol | 20 | % | Methanol | 20 | % |
| Transesterification yield | Crude RME/rapeseed oil | 96.78 | % | Crude RME/rapeseed oil | 99.1 | % |
| Analysis | Methyl ester cont. | 97.5 | % | Methyl ester cont. | 98.3 | % |
| | Monoglyceride | 1.08 | % | Monoglyceride | 0.81 | % |
| | Diglycerides | 0.2 | % | Diglycerides | 0.16 | % |
| | Triglycerides | 0.01 | % | Triglycerides | 0.04 | % |
| | free glycerol | 0.35 | % | free glycerol | 0.07 | % |
| | Total glycerol | 0.66 | % | Total glycerol | 0.3 | % |
| Neutralization | Crude RME | 100 | % | Crude RME | 100 | % |
| | Neutralization number | 0.36 | | Neutralization number | 0.071 | % |
| Neutralizing agent | Sulfuric acid | 0.48 | mg/gRME | Sulfuric acid | 0.095 | mg/gRME |
| Neutralization yield | Neutral/crude RME | 98.09 | % | Neutral/crude RME | 99.3 | |
| Analysis | Methyl ester cont. | 97.5 | % | Methyl ester cont. | 98.1 | % |
| | Monoglyceride | 1.08 | % | Monoglyceride | 0.89 | % |
| | Diglycerides | 0.21 | % | Diglycerides | 0.18 | % |
| | Triglycerides | 0.01 | % | Triglycerides | 0.04 | % |
| | Free glycerol | 0.05 | % | Free glycerol | 0.01 | % |
| | Total glycerol | 0.36 | % | Total glycerol | 0.27 | % |
| | Neutralization number | 0.044 | | Neutralization number | 0.026 | |
| | Acid number | 0.41 | | Acid number | 0.061 | |
| Neutralizing agent | Methanesulfonic acid | 1.36 | mg/gRME | Methanesulfonic acid | 0.267 | mg/gRME |
| Neutralization yield | Neutral/crude RME | 98.43 | % | Neutral/crude RME | 99.17 | |
| Analysis | Methyl ester cont. | 97.9 | % | Methyl ester cont. | 98.3 | % |
| | Monoglyceride | 0.93 | % | Monoglyceride | 0.88 | % |
| | Diglycerides | 0.18 | % | Diglycerides | 0.18 | % |
| | Triglycerides | 0.01 | % | Triglycerides | 0.04 | % |
| | Free glycerol | 0.02 | % | Free glycerol | 0.01 | % |
| | Total glycerol | 0.28 | % | Total glycerol | 0.26 | % |
| | Neutralization number | 0.022 | | Neutralization number | 0.022 | |
| | Acid number | 0.2 | | Acid number | 0.067 | |

The invention claimed is:

1. A process for preparing a fatty acid ester of a short-chain monohydric alcohol having 1 to 5 carbon atoms, comprising:

(a) transesterifying a fatty acid glyceride with a short-chain monohydric alcohol having 1 to 5 carbon atoms in the presence of at least one basic catalyst to form a reaction mixture which comprises the fatty acid ester of a short-chain monohydric alcohol having 1 to 5 carbon atoms; and (b) treating at least a portion of the reaction mixture formed in the transesterifying (a) with methanesulfonic acid.

2. The process of claim 1, wherein, in (a), on completion of transesterification and before performance of the treating (b), a residence time of the reaction mixture is such that a phase separation into a fatty acid ester phase and a glycerol phase takes place.

3. The process of claim 1, wherein the transesterifying in (a) is performed in more than one stage.

4. The process of claim 3, wherein the transesterifying in (a) is performed in two stages.

5. The process of claim 4, wherein 60% to 90% of a total amount of alcohol and catalyst employed is employed in the first stage, and 10% to 40% of the total amount of alcohol and catalyst employed is employed in the second stage.

6. The process of claim 1, wherein the fatty acid glyceride is at least one naturally occurring vegetable fat, vegetable oil, animal fat, or animal oil selected from the group consisting of soybean oil, palm oil, palm kernel oil, coconut oil, sunflower oil, rapeseed oil, linseed oil, castor oil, peanut oil, olive oil, evening primrose oil, and carob seed oil.

7. The process of claim 1, wherein the short-chain monohydric alcohol is methanol or ethanol.

8. The process of claim 1, wherein the basic catalyst is at least one basic alkali metal or alkaline earth metal compound selected from the group consisting of sodium hydroxide, potassium hydroxide, a sodium alkoxide of the short-chain monohydric alcohol having 1 to 5 carbon atoms, and a potassium alkoxide of the short-chain monohydric alcohol having 1 to 5 carbon atoms.

9. The process of claim 1, wherein the basic catalyst is employed in an amount of 0.5 to 5% by weight, based on a mass of the fatty acid glyceride present.

10. The process of claim 1, wherein an amount of the methanesulfonic acid in (b) is such that it is at least equivalent to an amount of the basic catalyst in the transesterifying (a).

11. The process of claim 2, wherein, on completion of the transesterifying in (a), the fatty acid ester phase is formed, removed, and treated with the methanesulfonic acid in (b).

12. The process of claim 1, wherein the methanesulfonic acid is employed in the form of a 50 to 99% aqueous acid for the treating in (b).

13. The process of claim 1, wherein performance of process the treating (b) is preceded by removal of excess alcohol from the transesterifying (a).

14. The process of claim 1, which is performed as a continuous process.

15. The process of claim 2, wherein the transesterifying in (a) is performed in more than one stage.

16. The process of claim 15, wherein the transesterifying in (a) is performed in two stages.

17. The process of claim 16, wherein 60% to 90% of a total amount of alcohol and catalyst employed is employed in the first stage, and 10% to 40% of the total amount of alcohol and catalyst employed is employed in the second stage.

18. The process of claim 2, wherein the fatty acid glyceride is at least one naturally occurring vegetable fat, vegetable oil, animal fat, or animal oil selected from the group consisting of soybean oil, palm oil, palm kernel oil, coconut oil, sunflower oil, rapeseed oil, linseed oil, castor oil, peanut oil, olive oil, evening primrose oil, and carob seed oil.

19. The process of claim 2, wherein the short-chain monohydric alcohol is methanol or ethanol.

20. The process of claim 1, wherein the short-chain monohydric alcohol is methanol, the basic catalyst is potassium methoxide or sodium methoxide, and the methanesulfonic acid is in the form of a 50 to 99% aqueous solution.

* * * * *